United States Patent [19]

Mans et al.

[11] Patent Number: 5,023,518

[45] Date of Patent: Jun. 11, 1991

[54] BALLAST CIRCUIT FOR GASEOUS DISCHARGE LAMP

[75] Inventors: Wayne K. Mans, Bridgewater; Vincent J. Rizzo, Basking Ridge, both of N.J.

[73] Assignee: Joseph A. Urda, Basking Ridge, N.J.

[21] Appl. No.: 283,255

[22] Filed: Dec. 12, 1988

[51] Int. Cl.[5] ..... H05B 37/02; H05B 41/16; H05B 39/04; G05F 1/00

[52] U.S. Cl. ..... 315/219; 315/208; 315/DIG. 4; 315/DIG. 7; 315/307; 315/276; 315/287

[58] Field of Search ..... 315/219, DIG. 7, 307, 315/DIG. 4, 276, 287, 209 R, 208

[56] References Cited

U.S. PATENT DOCUMENTS

| | | | |
|---|---|---|---|
| 3,438,023 | 4/1969 | Apitz | 315/209 |
| 3,440,488 | 4/1969 | Skirvin | 315/209 |
| 3,621,331 | 11/1971 | Barron | 315/207 |
| 4,087,722 | 5/1978 | Hancock | 315/200 A |
| 4,158,793 | 1/1979 | Lewis | 315/101 |
| 4,236,332 | 8/1982 | Walden | 315/307 |
| 4,368,406 | 1/1983 | Kruzich et al. | 315/158 |
| 4,373,146 | 2/1983 | Bonazoli et al. | 315/209 R |
| 4,415,839 | 11/1983 | Lesea | 315/308 |
| 4,472,661 | 9/1984 | Culver | 315/219 |
| 4,492,899 | 1/1985 | Martin | 315/308 |
| 4,503,363 | 3/1985 | Nilssen | 315/DIG. 7 |
| 4,523,128 | 6/1985 | Stamm et al. | 315/291 |
| 4,524,305 | 6/1985 | Martin | 315/221 |
| 4,529,913 | 7/1985 | Brosillon | 315/DIG. 4 |
| 4,554,487 | 11/1985 | Nilssen | 315/224 |
| 4,613,934 | 9/1986 | Pacholok | 363/131 |
| 4,682,082 | 7/1987 | MacAskill et al. | 315/219 |
| 4,692,667 | 9/1987 | Nilssen | 315/209 R |
| 4,704,563 | 11/1987 | Hussey | 315/307 |
| 4,705,991 | 11/1987 | Ganser et al. | 315/209 R |
| 4,870,326 | 9/1989 | Andersen et al. | 315/DIG. 7 |
| 4,881,014 | 11/1989 | Okochi | 315/DIG. 7 |

OTHER PUBLICATIONS

Circuit Diagram, "Sch. UPS BRD Writer Module," Techlite, Kile Technology, Inc., 13-0316-02, Jun. 3, 1987.

Circuit Diagram, "Sch. Universal Power Source," Techlite, Kile Technology, Inc.

*Primary Examiner*—Eugene R. LaRoche
*Assistant Examiner*—Michael B. Shingleton
*Attorney, Agent, or Firm*—R. Neil Sudol; Henry D. Coleman

[57] ABSTRACT

A ballast circuit for a gaseous discharge lamp, particularly a neon light, includes a diode bridge rectifier for producing a d-c voltage from an a-c input and a transformer with a secondary winding connected to the lamp and a primary winding connected to the rectifier. A switching circuit is connected to the transformer primary winding for controlling a flow of current therethrough from the rectifier. The switching circuit includes at least one MOSFET having a drain terminal connected to the transformer primary winding and a grounded source terminal. A control circuit is connected to a gate terminal of the MOSFET for controlling the on and off times thereof, the control circuit including a pulse generator for producing a train of pulse-width-modulated rectangular pulses of substantially a single frequency fed to the MOSFET's gate terminal. The pulse generator includes circuitry for changing the width of the rectangular pulses to enable a gradual energization of the gaseous discharge lamp from one end thereof towards an opposite end to create a writing effect of selectively different speeds in the gaseous discharge lamp. The circuitry in the pulse generator for changing the pulse width can be used to control the widths of the pulses so that the pulses are a train of square waves having a common duration equal to an interpulse period, whereby striations are generated in the gaseous discharge lamp.

22 Claims, 5 Drawing Sheets

HIGH VOLTAGE SENSING SAFETY CIRCUIT
16
$V_I$
74
24
20
22
28
18
42
$V_S$
36
$V_W$
$V_F$
DISPLAY DRIVE UNIT
$V_{BL}$
38
40
UNIQUE VOLTAGE FEEDBACK AND PWM CONTROL UNIT
26
$V_F$
34
$V_C$
PWM PULSE GENERATOR AND MOSFET DRIVE UNIT
14
12
30
32
10

46
D1
D2
CB
VB
50
RH
CT
VE
CH
DH
D3
D4
52
26
VF
48
44
+12 V
Q4
34
VC
R3
Q3
Q1
R1
Q2
R2

BALLAST CIRCUIT FOR GASEOUS DISCHARGE LAMP

BACKGROUND OF THE INVENTION

This invention relates to a ballast circuit for a gaseous discharge lamp. More particularly, this invention relates to such a circuit for generating special decorative effects in the illumination or energization of gaseous discharge lamps such as neon lights.

The power supplies and electronic drive circuitry that are currently being used to operate high-voltage neon tubes genrally consist of a high-voltage transformer and high-power solid state electrical devices. These power units are frequently very bulky, costly and inefficient, particularly if any type of display variations are incorporated into the design. Moreover, the high voltages present in the devices result in a potentially dangerous situation if a tube is accidentally damaged or broken.

With respect to possible display variations, it is known to control the energization of a neon light to produce a "writing" effect wherein the illuminated portion of the neon tube gradually increases in length from one end of the tube towards the other end thereof. Other special decorative effects which are achievable in neon lighting include flashing or blinking, a "bubbling" or striation effect, and a dimming or light modulation effect.

U.S. Pat. No. 3,440,488 to Skirvin discloses a circuit connectable to a gas-filled luminescent tube for illuminating progressive portions of the tube, i.e., for achieving a "writing" effect. The increase in the length of the illuminated portion of a gas-filled luminescent tube is achieved by varying the voltage, current and/or frequency of the input excitation signal. A resonant tank circuit including a capacitor and the primary winding of a transformer operatively connected to the flourescent tube is fed a polarized waveform having a frequency which is increased as power input to the waveform generating circuit (comprising a silicon controlled rectifier) is increased. The power supplied to the waveform generating circuit is increased by increasing the "on" time of another silicon controlled rectifier via a light source and a light sensitive potentiometer.

U.S. Pat. No. 4,682,082 to MacAskill et al. relates to an electronic energization circuit for illuminating a gas discharge lamp and includes a transformer with a rectangular hysteresis loop. A secondary winding of the transformer is connected to the gas discharge lamp, while at least one primary winding of the transformer is connected to a transistor in turn tied to input terminals of the energization circuit. The transistor is controlled to have unequal on and off periods to eliminate striations in the gas plasma of the discharge lamp.

U.S. Pat. No. 4,415,839 to Lesea describes and illustrates an electronic ballast circuit with two series connected MOSFETs having a common output connected to a gaseous discharge lamp via a voltage-conditioning and current-limiting network. The MOSFETs are also connected to a d-c power supply and to a pulse generating circuit which turns the MOSFETs alternately on and off in response to feedback signals from the load and from a source terminal of one of the MOSFETs. In one embodiment of the ballast circuit, the signal on the common output of the two MOSFETs is a series of alternating positive and negative pulses varying in frequency and duration. In another embodiment of the ballast circuit, the load is driven by a triangular wave signal which is amplitude modulated in response to a feedback signal.

U.S. Pat. No. 4,087,722 to Hancock involves a circuit for energizing a gaseous discharge tube. The energization circuit includes a subcircuit for generating a square wave signal of varying pulse width to vary the output intensity of the gaseous discharge tube in accordance with ambient light conditions. The subcircuit is provided with photoresistors which change their resistance in response to the ambient light and thereby alter the trigger times of a pair of silicon controlled rectifiers. A flashing effect in the gaseous discharge tube is implemented by a transistor which grounds trigger inputs of the silicon controlled rectifiers under the control of a timing circuit.

U.S. Pat. No. 4,704,563 to Hussey discloses a fluorescent lamp operating circuit with a system for intensity control. At the center of the intensity control system are two transistors connected in a half-bridge arrangement and switched by high frequency signals produced by a pulse width modulation controller. The controller is triggered if two successive binary codes are detected on a power line by a receiver circuit. The output of the two transistors is fed to the primary winding of a transformer.

U.S. Pat. No. 4,492,899 to Martin is directed to a solid state regulated power supply for a cold cathode luminous tube, wherein the repetition rate of power pulses to the luminous tube is varied to compensate for temperature and load changes. The tube is connected to a secondary winding of a transformer having a primary winding connected on one side to a power source and on an opposite side to a transistor switch. The frequency of a control signal fed to the base of the transistor changes in response to variations in a feedback signal originating at an auxiliary secondary winding of the transformer. The power supply includes several potentiometers for setting power, pulse width and temperature zeros or norms.

OBJECTS OF THE INVENTION

An object of the present invention is to provide an efficacious electronic ballast circuit for a gaseous discharge lamp.

Another object of the present invention is to provide such a ballast circuit which is reliable and efficient.

Another, more particular, object of the present invention is to provide such a ballast circuit which generates a writing effect.

A further particular object of the present invention is to provide such a ballast circuit which generates striations or bubbles along the length of a neon tube.

Yet another particular object of the present invention is to provide such a ballast circuit which effectively eliminates large, high-power devices to drive neon tubes.

An additional object of the present invention is to provide such a ballast circuit wherein the output intensity is completely and automatically adjustable to compensate for different tube lengths, different tube diameters, different discharge gases and different display effects.

A further object of the present invention is to provide such a ballast circuit which is safe.

SUMMARY OF THE INVENTION

An electronic ballast circuit for controlling the energization of a gaseous discharge lamp comprises, in accordance with the present invention, a power source for producing a d-c voltage, a power supply or transmission circuit operatively connected to the power source and operatively connectable to the gaseous discharge lamp for transferring electrical power thereto from the power source, and a switching circuit connected to the power supply circuit for controlling a flow of current from the power source through the power supply circuit. The switching circuit includes at least one MOSFET having a drain terminal connected to the power supply circuit and a grounded source terminal. A control circuit is connected to a gate terminal of the MOSFET for controlling the on and off times thereof, the control circuit including a pulse generator for producing a train of pulse-width-modulated rectangular pulses of substantially a single frequency fed to the MOSFET's gate terminal.

In accordance with a particular embodiment of the present invention, the rectangular pulses fed to the gate terminal of the MOSFET have a pulse width sufficiently large to cause substantially instantaneous illumination of the gaseous discharge lamp along substantially the entire length thereof upon an initial application of power to the lamp, e.g., upon activation of the ballast circuit.

In accordance with another particular embodiement of the present invention, the rectangular pulses fed to the gate terminal of the MOSFET have a pulse width sufficiently small to cause partial illumination of the gaseous discharge lamp upon an initial application of power to the lamp, e.g., upon activation of the ballast circuit, and a gradual increase in the length of the illumination during subsequent continued application of power to the lamp.

Pursuant to another feature of the present invention, the pulse generator includes circuitry for changing the width of the rectangular pulses to enable a gradual energization of the gaseous discharge lamp from one end thereof at a variable rate towards an opposite end, thereby creating a writing effect of selectably different speeds in the lamp.

In accordance with another feature of the present invention, the circuitry in the pulse generator for changing the pulse width can be used to control the widths of the pulses so that the pulses are a train of square waves having a common duration equal to an interpulse period, whereby striations are generated in the lamp.

Advantageously, the switching circuit includes a plurality of MOSFETs connected in parallel to one another between the power supply circuit and ground.

Pursuant to yet another embodiment of the present invention, the pulse generator includes (a) a feedback circuit for generating a feedback voltage proportional to a voltage drop in the power supply circuit, (b) a first reference generating circuit for producing a reference or control voltage, (c) a differencing circuit operatively connected to the first reference generating circuit and to the feedback circuit for generating a signal encoding a difference between the control voltage and the feedback voltage, (d) a second reference generating circuit for generating a sawtooth reference voltage, and (e) a comparator operatively connected to the differencing circuit and the second reference generating circuit for producing the train of pulse-width-modulated rectangular pulses, the comparator having an output operatively connected to the gate terminal of the MOSFET.

Preferably, the first reference generating circuit includes an oscillator for generating a rectangular waveform having a pre-established amplitude and periodicity and further includes circuitry for producing the control voltage from the rectangular waveform. The first reference generating circuit may also include a manually adjustable element operatively connected to the differencing circuit and to the oscillator for modifying the amplitude of the rectangular waveform fed from the oscillator to the differencing circuit so that the width of the rectangular pulses transmitted from the control circuit to the MOSFET gate is changed to produce a writing effect of different speeds in the gaseous discharge lamp.

A ballast circuit in accordance with the present invention is reliable, efficient and durable. It is relatively inexpensive to manufacture. Is is lightweight and effectively eliminates large, high-power devices. The safety feature instantly turns off the high voltage and the ballast circuit, once turned off by the safety design feature, cannot be reset until the power is turned off and the defect is repaired. In some instances, repair may involve merely the replacement of a fuse, the rest of the circuitry remaining unaffected by a power pulse or spike which blew the fuse.

By virtue of the voltage feedback feature, a ballast circuit in accordance with the present invention has an output which is completely and automatically adjustable to compensate for different tube lengths, different tube diameters, different discharge gases and different display effects. A ballast circuit as described and illustrated herein can operate at a wide range of input power voltages because the voltage feedback circuitry compensates for changes in line voltage, as well as holding the intensity of the tube's illumination constant.

DETAILED DESCRIPTION

Figure 1:
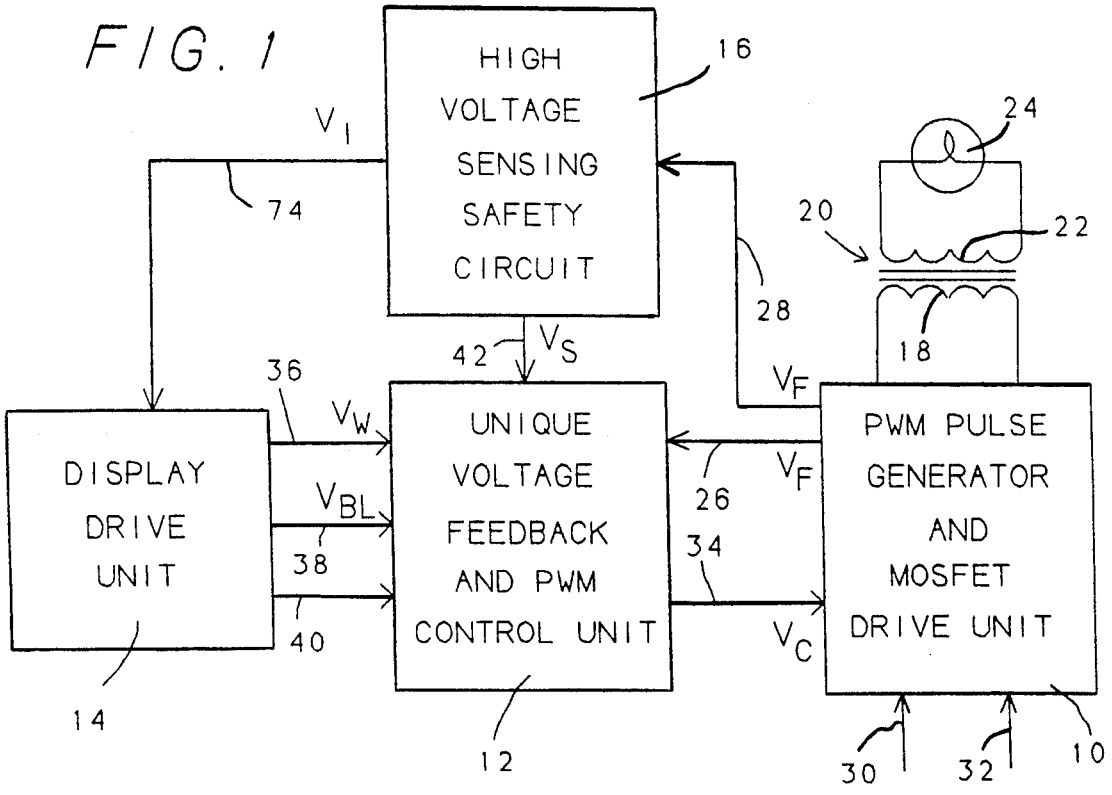
FIG. 1 is a block diagram of an electronic ballast circuit in accordance with the present invention, showing a pulse-width-modulation (PWM) and MOSFET drive unit, a voltage feedback and PWM control unit, a display drive unit and a high-voltage sensing safety circuit.

As illustrated in FIG. 1, an electronic ballast circuit in accordance with the present invention includes a pulse-width-modulation (PWM) and MOSFET drive unit 10, a voltage feedback and PWM control unit 12, a display drive unit 14, and a high-voltage sensing safety circuit 16. The PWM and MOSFET drive unit 10 is connected at an output to a primary winding 18 of a transformer 20 having a secondary winding 22 connected to a neon light 24.

The PWM and MOSFET drive unit 10 has an output lead 26 extending to voltage feedback and PWM control unit 12 for delivering thereto a feedback voltage $V_F$ proportional to the voltage drop across primary winding 18 of transformer 20. Another lead 28, extending from PWM and MOSFET drive unit 10 to safety circuit 16, carries voltage feedback signal $V_F$ to the safety circuit. The PWM and MOSFET drive unit 10 has a pair of input leads 30 and 32 carrying a 60-cycle 115-volt a-c power signal or a 75–150 volt d-c power signal and another input lead 34 extending from voltage feedback and PWM control unit 12 for transmitting to the PWM and MOSFET drive unit a control signal $V_C$. Control signal $V_C$ is a low voltage, constant amplitude, fixed frequency signal with a varying on/off duty cycle, i.e., it a pulse-width-modulated signal of a single frequency (preferably approximately 25 kHz) and constant amplitude. The output of PWM and MOSFET drive unit 10 is a 100–500 volt peak-to-peak signal with the same duty cycle as the input.

Voltage feedback and PWM control unit 12 has three input leads 36, 38 and 40 extending from display drive unit 14. Lead 36 carries a signal or reference voltage $V_W$ for controlling a "writing" rate, i.e., a rate at which an energized portion of neon light 24 grows from one end of the neon tube towards the other end thereof, or, alternatively, from the ends of the tube towards the middle thereof. Lead 38 transmits a signal or reference voltage $V_{BL}$ for determining the energized and de-energized periods of neon light 24 in a flashing mode of operation of the electronic ballast circuit. Lead 40 is provided for transmitting optional signals to determine such parameters as light intensity, forms and motion.

Safety circuit 16 is connected to voltage feedback and PWM control unit 12 via an output lead 42. Lead 42 transmits a signal or reference voltage $V_S$ for steady state state operation of the ballast circuit. As described in detail hereinafter with reference to FIG. 5, voltage $V_S$ drops to zero and thereby halts the operation of voltage feedback and PWM control unit 12 and prevents the transmission of control signal $V_C$ to PWM and MOSFET drive unit 10 in the event that the safety circuit detects an excessively high voltage drop across primary winding 18 of transformer 20.

Figure 2:
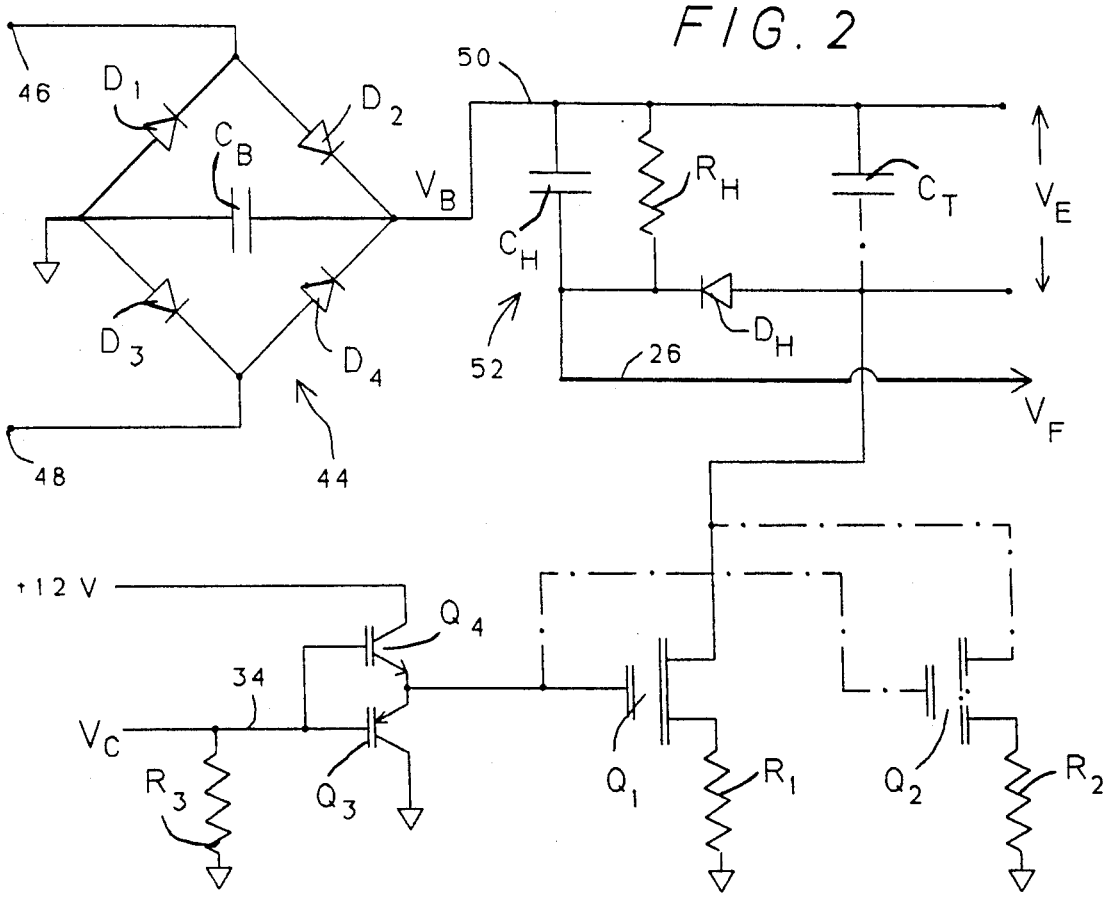
FIG. 2 is a circuit diagram showing a bridge-type rectifier circuit, a MOSFET drive circuit and an energy storage circuit included in the PWM and MOSFET drive unit of FIG. 1.

As depicted in FIG. 2, PWM and MOSFET drive unit 10 includes a conventional full-wave bridge rectifier 44 connectable at input terminals 46 and 48 to power transmission leads 30 and 32 (FIG. 1). Rectifier 44 includes four diodes $D_1$, $D_2$, $D_3$ and $D_4$ and a capacitor $C_B$ grounded at one end and tied at an opposite end to primary winding 18 of transformer 20 via a lead 50. Lead 50 carries a d-c signal from the power source rectifier 44 to transformer 20.

Connected across transformer primary winding 18 is an energy storage circuit 52 comprising a resistor $R_H$ and a capacitor $C_H$, through which current flows during an off period of a MOSFET switch $Q_1$. MOSFET $Q_1$ has a drain terminal connected to primary winding 18 and a source terminal grounded via a resistor $R_1$. Capacitor $C_H$ serves as an energy storage element for the intervals when MOSFET $Q_1$ is in a non-conductive state due to the absence of a signal at its gate terminal. As shown in FIG. 2, capacitor $C_H$ and resistor $R_H$ are connected across primary winding 18 in series with a diode $D_H$. An additional capacitor $C_T$ may be provided, as indicated in dashed lines, for changing the power factor to meet the local power company's power requirement. Capacitor $C_T$ also serves to remove transients from the drain of MOSFET $Q_1$.

A PWM drive and 25 kHz operating frequency allows the use of a small transformer and provides for low MOSFET power dissipation. Resistor $R_H$ is the only power dissipation component; the current in resistor $R_H$ discharges capacitor $C_H$ during the "off" times of MOSFET $Q_1$.

Feedback lead 26 is tied at an input end to energy storage circuit 52 at the junction between diode $D_H$, on the one hand, and capacitor $C_H$ and resistor $R_H$, on the other hand.

In applications where the current through transformer primary winding 18 is expected to be substantial, for example, when striations or "bubbles," i.e.. alternating light and dark bands, are to be formed along the length of the illuminated neon light 24, at least one additional MOSFET switch $Q_2$ is advantageously connected in parallel to MOSFET $Q_1$ between primary winding 18 and ground. MOSFET $Q_2$ has its source terminal tied to current limiting resistor $R_2$. MOSFETs $Q_1$ and $Q_2$ are preferably highly efficient and have low "on" resistances. The purpose of having MOSFETs $Q_1$ and $Q_2$ connected in parallel is to enable current sharing: a larger current in one MOSFET $Q_1$ or $Q_2$ will decrease the gate drive, which increases the "on" resistance of that MOSFET and forces more current to flow in the other MOSFET.

When MOSFETs $Q_1$ and $Q_2$ are in a conductive state, one side of transformer 20 is pulled to ground and, since the other side of the transformer is connected to rectifier 44 via lead 50, current will flow through primary winding 18 and MOSFETs $Q_1$ and $Q_2$. When MOSFETs $Q_1$ and $Q_2$ are in a nonconductive state, the current through the inductance of transformer 20 must continue and will flow through diode $D_H$ and storage capacitor $C_H$ to a voltage required to maintain current flow through transformer 20. If MOSFETs $Q_1$ and $Q_2$ are conductive for longer periods of time, more current will flow and the feedback voltage $V_F$ will increase, inasmuch as the current through primary winding 18 of transformer 20 is proportional to the difference between feedback voltage $V_F$ and the voltage $V_B$ on lead 50. Feedback voltage $V_F$ is thus proportional to the pulse width of control voltage $V_C$.

The gate terminals of MOSFETs $Q_1$ and $Q_2$ are connected to a pair of transistors $Q_3$ and $Q_4$ whose bases receive control voltage $V_C$ via lead 34. Transistor $Q_4$ is an NPN transistor that supplies the positive drive to switch MOSFETs $Q_1$ and $Q_2$ into a conductive state. Transistor $Q_3$ is a PNP transistor which itself becomes conductive when control voltage $V_C$ is low and thereby removes all charge from the gates of MOSFETs $Q_1$ and $Q_2$ to switch them into a nonconductive state. The simple drive circuit illustrated in FIG. 2, together with the fact that all MOSFETs require basically the same gate drive voltage, enables MOSFETs $Q_1$ and $Q_2$ to be selected according to the application, depending on the maximum voltage and current requirements.

Figure 3:
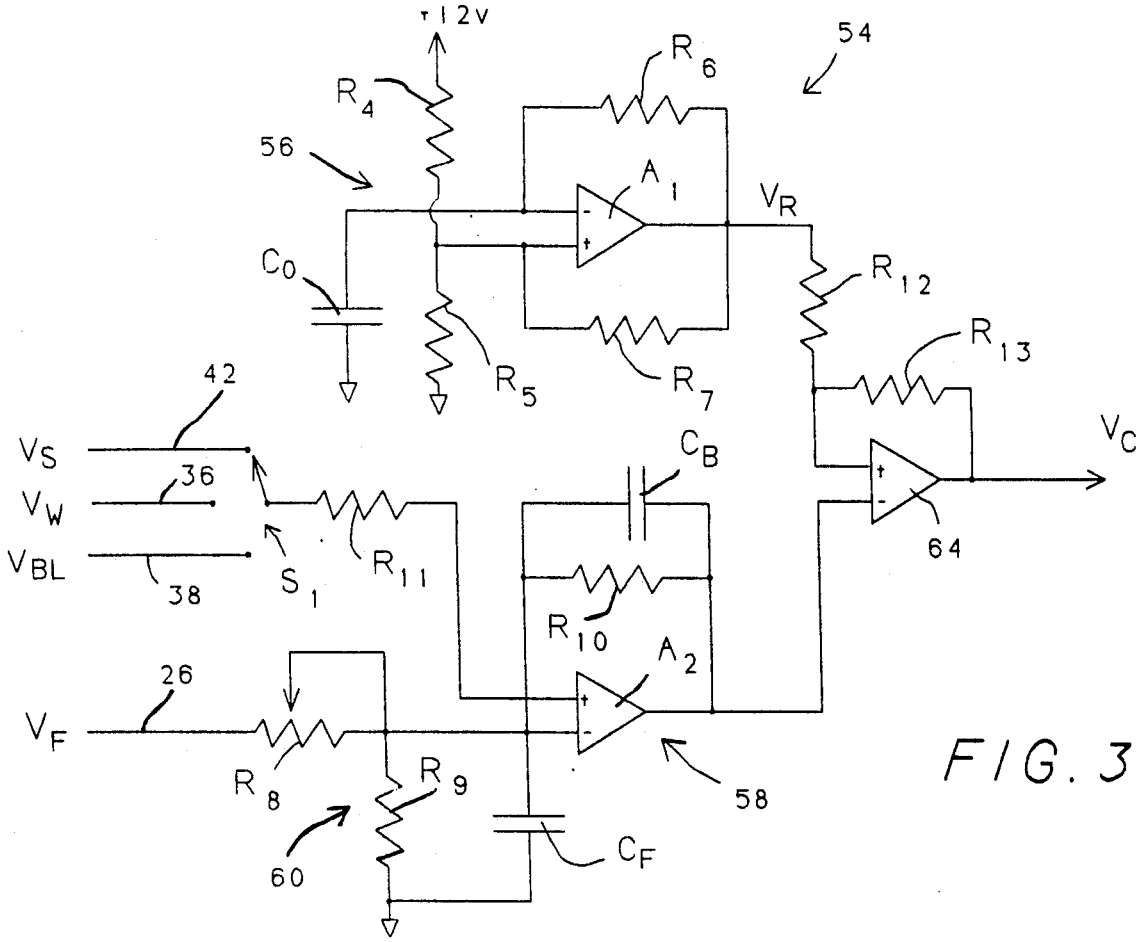
FIG. 3 is a circuit diagram showing a differencing circuit, a reference voltage generating circuit and a comparator included in the voltage feedback and PWM control unit of FIG. 1.

As illustrated in FIG. 3, voltage feedback and PWM control unit 12 comprises a 25 kHz sawtooth-voltage generator or oscillator 54 which includes an operational amplifier $A_1$ having an inverting input tied to ground via a capacitor $C_0$ and a noninverting input connected to a voltage divider 56 comprising resistors $R_4$ and $R_5$. Voltage divider 56 is grounded at one end and supplied with a 12 volt potential at an opposite end. The inverting and noninverting inputs of operational amplifier $A_1$ are connected to the output of the amplifier via respective resistors $R_6$ and $R_7$. The period of a 25 kHz ramp or sawtooth voltage $V_R$ at the output of generator or oscillator 54 corresponds to the time constant of the generator and is determined by the product of the capacitance of capacitor $C_0$ and the resistance of resistor $R_7$. Resistors $R_4$, $R_5$, and $R_7$ are feedback resistors for setting the switching levels.

Voltage feedback and PWM control unit 12 also comprises a feedback summing circuit 58 which includes an operational amplifier $A_2$ having an inverting input tied to ground via a capacitor $C_F$ and a resistor $R_9$. The inverting input of operational amplifier $A_2$ receives feedback voltage $V_F$ from PWM and MOSFET drive unit 10 via led 26 and via an intensity adjustment component in the form of a voltage divider 60 which includes a potentiometer $R_8$ and resistor $R_9$. The inverting input of operational amplifier $A_2$ is also connected to the output of the amplifier via a capacitor $C_B$ and a resistor $R_{10}$.

Operational amplifier $A_2$ has a noninverting input which receives, via a resistor $R_{11}$, a reference voltage selected from among several voltages by an operator via a switch $S_1$. A first selectable voltage is reference voltage $V_S$, which arrives at switch $S_1$ via lead 42 (FIGS. 1, 3 and 5) and is a constant-amplitude d-c voltage for producing a steady state energization of neon light 24. Reference voltage $V_S$ is of such a magnitude (12 volts) that the resulting, relatively large, pulse width of control voltage $V_C$ causes essentially the entire length of neon light 24 to be illuminated upon activation by the ballast circuit. Thus, if neon light 24 is to remain energized at a constant illumination, switch $S_1$ is set to connect lead 42 to operational amplifier $A_2$. In that event the summing resistors cause a nulling of feedback voltage $V_F$ and the 12 volt reference voltage $V_S$.

Another reference voltage $V_W$, arriving at switch $S_1$ via lead 36 (FIGS. 1, 3 and 4), is a rectangular waveform having an amplitude which is sufficiently small to produce a "writing" effect, i.e., a gradually increasing energization of neon light 24 from one end thereof towards an opposite end, or from the ends towards the center, depending on the grounding of the neon tube. The pulse duration and frequency of reference voltage $V_W$ respectively determine the "on" time and the flashing frequency of neon light 24, while the amplitude of reference voltage $V_W$ determines the pulse width of control voltage $V_C$ and, consequently, the writing rate.

Yet another reference voltage $V_{BL}$, arriving at switch $S_1$ via lead 38 (FIGS. 1, 3 and 4), is a rectangular waveform having an amplitude sufficiently large (e.g., 12 volts) so that the entire length of neon light 24 is essentially instantaneously illuminated at the onset of each positive pulse. The pulse frequency and duration determine the frequency and duration of neon light illumination.

Varying the resistance value of potentiometer $R_8$ will cause a change in the illumination level of neon light 24 by changing the PWM pulse width until feedback voltage $V_F$ is nulled with the other input of operational amplifier $A_2$. Capacitors $C_B$ and $C_F$ together with resistors $R_9$ and $R_{10}$ form the compensation for the closed loop system bandwidth.

Amplifier $A_2$ essentially produces a signal proportional to the difference between feedback voltage $V_F$ and the reference voltage $V_S$, $V_W$ or $V_{BL}$. This signal is fed to an inverting input of a comparator 64, whose noninverting input is tied to the output of generator 54 for receiving therefrom, via a resistor $R_{12}$, the 25 kHz ramp or sawtooth voltage $V_R$, which serves as a reference voltage for the comparator. In response to the difference between sawtooth voltage $V_R$ and the signal from summing amplifier $A_2$, comparator 64 generates control voltage $V_C$ and transmits that voltage to PWM and MOSFET drive unit 10 via lead 34. The output of comparator 64 is also connected to its noninverting input via a resistor $R_{13}$.

Figure 4:
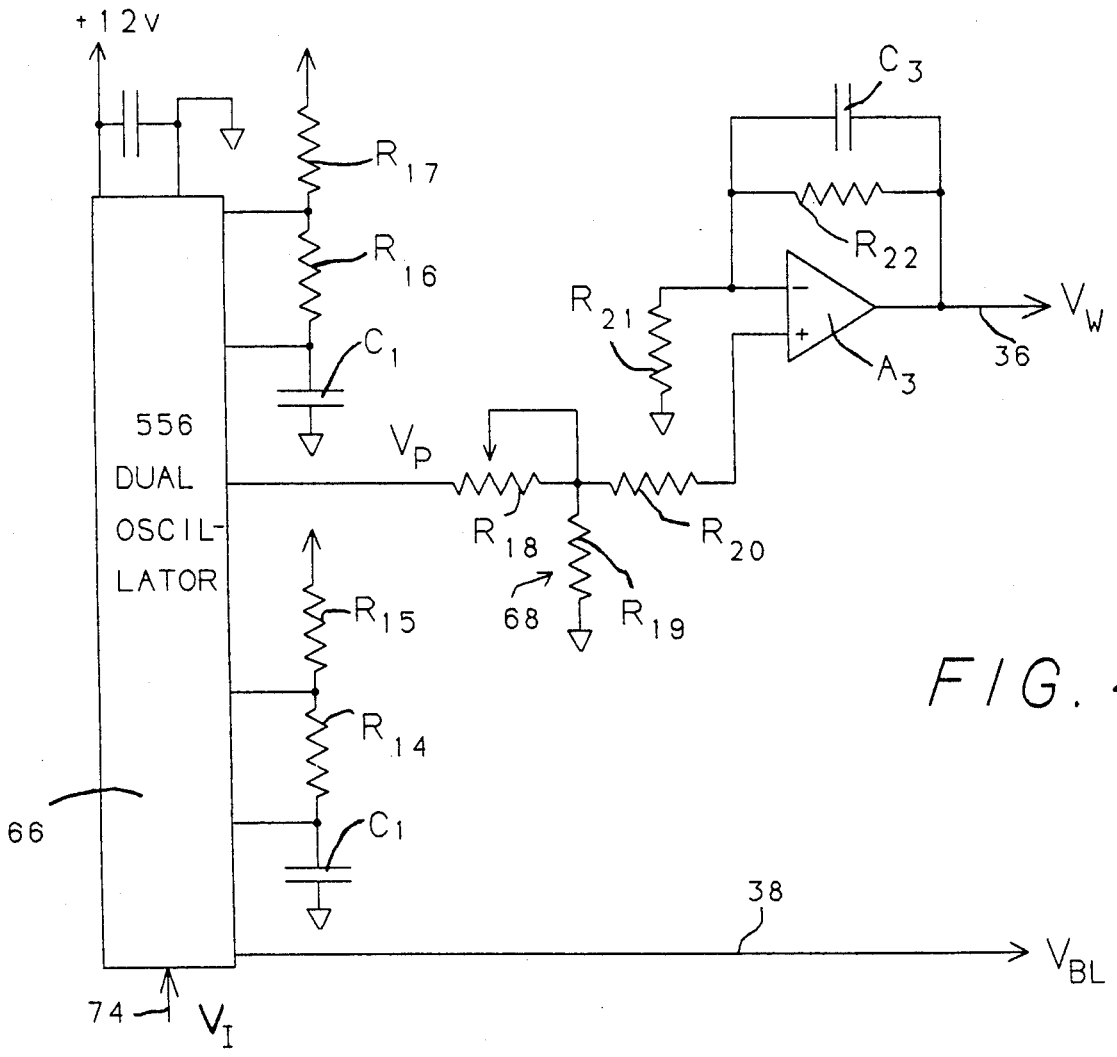
FIG. 4 is a circuit diagram showing details of the display drive unit of FIG. 1.

As illustrated in FIG. 4, display drive unit 14 includes a standard 556 timer used as a dual oscillator 66. One oscillator is used to generate reference voltage $V_{BL}$ and thus set the flashing rate in the blinking mode of the ballast circuit. The duration of the pulses of reference voltage $V_{BL}$ is determined by resistor $R_{14}$ and capacitor $C_1$, while the interpulse interval is set by resistors $R_{14}$ and $R_{15}$ and capacitor $C_1$.

The other oscillator of dual oscillator 66 is used to generate a rectangular waveform $V_P$ from which reference voltage $V_W$ is derived, as detailed hereinafter. The pulse duration and interpulse interval of waveform $V_P$ control the on and off times of neon light 24 in the writing mode of the ballast circuit. The duration of the pulses of rectangular waveform $V_P$ is determined by resistor $R_{16}$ and capacitor $C_2$, while the interpulse interval is set by resistors $R_{16}$ and $R_{17}$ and capacitor $C_2$.

The amplitude of rectangular waveform $V_P$ is manually adjustable by means of a potentiometer $R_{18}$ which forms a portion of a voltage divider 68, another portion of which is formed by a resistor $R_{19}$. Modifying the amplitude of rectangular waveform $V_P$ changes the amplitude of reference voltage $V_W$ and consequently varies the pulse width of control voltage $V_C$ and the "writing" rate of the ballast circuit, i.e., the rate at which the illuminated portion of neon light 24 increases in length. In some applications, potentiometer $R_{18}$ is replaced by a fixed resistance selected in part according to the tube length of neon light 24.

As depicted in FIG. 4, voltage divider 68 is connected to the noninverting input of an operational amplifier $A_3$ via a resistor $R_{20}$. The inverting input of operational amplifier $A_3$ is grounded via a resistor $R_{21}$ and is connected to the output of the amplifier via a resistor $R_{22}$ and a capacitor $C_3$. Operational amplifier $A_3$ amplifies its input to a suitable potential and transmits its output signal, reference voltage $V_W$, to switch $S_1$ for possible further transmission to differencing amplifier $A_2$ (FIG. 3).

Figures 5, 6:
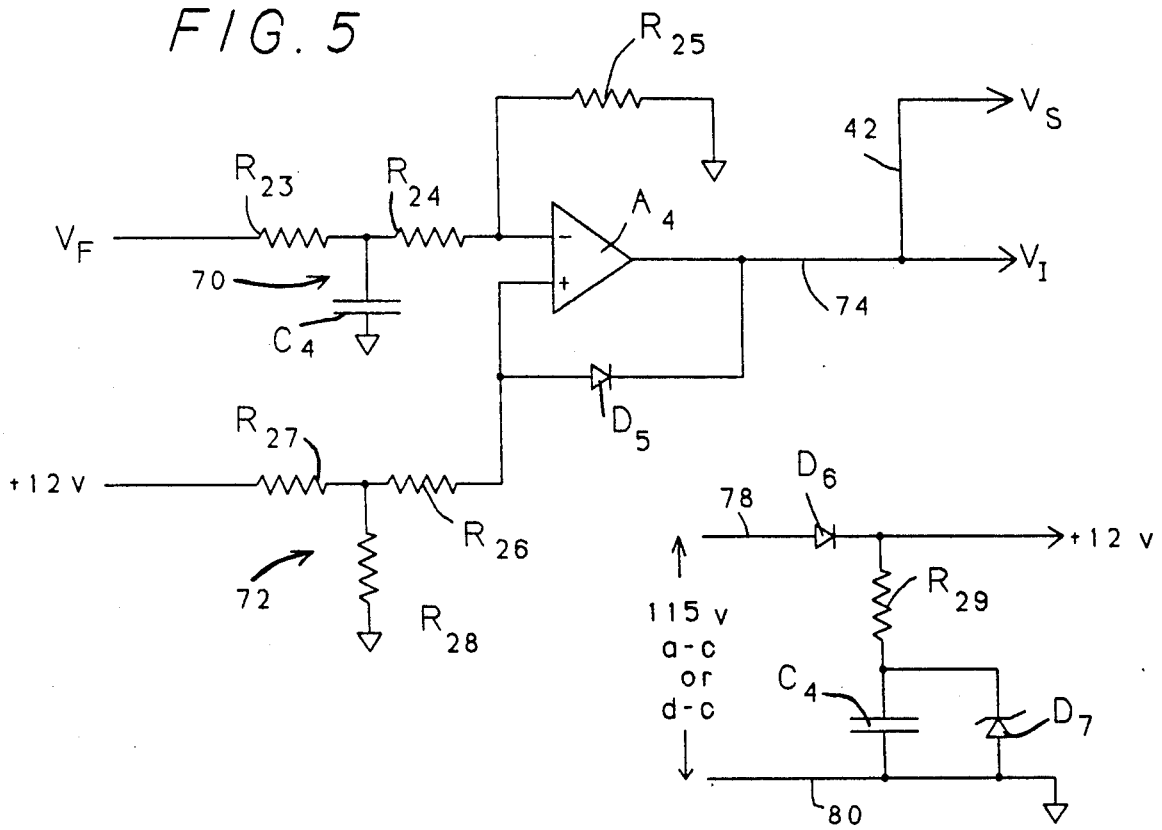
FIG. 5 is a circuit diagram of the high-voltage sensing safety circuit of FIG. 1.
FIG. 6 is a circuit diagram of a low voltage supply for the electronic ballast circuit of FIG. 1.

As shown in FIG. 5, safety circuit 16 comprises an operational amplifier $A_4$ with an inverting input receiving feedback voltage $V_F$ via a filtering and voltage dividing circuit 70 which includes a first resistor $R_{23}$, a capacitor $C_4$, a second resistor $R_{24}$ and another resistor $R_{25}$. A noninverting input of operational amplifier $A_4$ is connected to a 12-volt d-c source (see FIG. 6) via a voltage divider 72 and a resistor $R_{26}$, voltage divider comprising two resistors $R_{27}$ and $R_{28}$. Operational amplifier $A_4$ functions as a comparator which generates an interrupt or stop signal $V_I$ on an output lead 74 upon detecting that feedback voltage $V_F$ has exceeded a threshold potential set in part by voltage divider 72 and resistor $R_{25}$. Output lead 74 works into dual oscillator 66 of display drive circuit 14 (FIGS. 1 and 4), whereby the production of rectangular waveform $V_P$ and reference voltage $V_{BL}$ is arrested upon the appearance of interrupt signal $V_I$. Interrupt signal $V_I$ is advantageously identical to reference voltage $V_S$, conducted via lead 42 (FIGS. 1, 3 and 5) to switch $S_1$ for controlling energization of neon light 24 in a steady state operating mode of the ballast circuit. Accordingly, operational amplifier $A_4$ normally generates a high-level potential on leads 74 and 42 and reduces that potential to zero in the event that an excessive large feedback voltage $V_F$ is detected.

Safety circuit 16 serves to interrupt or stop the production of high voltages in the ballast circuit to eliminate the possibility of high-voltage electrical shock in the event that the neon tube is damaged or broken. When the tube is open circuited (i.e., broken), a voltage transient is reflected back to the input side of transformer 20. Safety circuit 16 detects the transient and interrupts the production of high voltage.

When the ballast circuit is energized or activated, the output of operational amplifier $A_4$ is high because the positive 12 volts appears before feedback voltage $V_F$. Generally, the output potential on leads 74 and 42 is 12 volts and the neon tube operates normally. If a transient occurs, the operational amplifier $A_4$ will flip low and remain low because a diode $D_5$ connected between the noninverting input of the operational amplifier and the output thereof starts conducting and damps the noninverted input voltage to a level below the potential at the inverting input of the amplifier.

As illustrated in FIG. 6, the 12 volt d-c potential for the ballast circuit is generated by a subcircuit comprising a half-wave bridge 76 including a first diode $D_6$, a Zener diode $D_7$, a resistor $R_{29}$ and a capacitor $C_4$. The subcircuit has input leads 78 and 80 for receiving a 115 volt a-c or d-c power voltage.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proferred by way of example to facilitate comprehension of the invention and should not be construed to limit the scope thereof.

What is claimed is:

1. An electronic ballast circuit for energizing a gaseous discharge lamp, comprising in combination:

power source means for producing a d-c voltage;

power supply means including a transformer operatively connected to said power source means and operatively connectable to the gaseous discharge lamp for transferring electrical power thereto from said power source means;

switching means connected to said power supply means for controlling a flow of current from said power source means through said power supply means, said switching means including at least one MOSFET having a drain terminal connected to said power supply means and a grounded source terminal;

control means connected to a gate terminal of said MOSFET for controlling the on and off times of said switching means, said control means including pulse generation means for generating a train of pulse-width-modulated rectangular pulses of substantially a single frequency fed to said gate terminal; and discharge means operatively connected to said supply means for discharging said transformer during an off period of said MOSFET, said discharge means including a resistor and a capacitor connected in parallel across a primary winding of said transformer.

2. The electronic ballast circuit set forth in claim 1 wherein said power supply means comprises a step-up transformer having a primary winding connected at one end to said power source means, said step-up transformer having a secondary winding connectable to said lamp, said switching means being connected to said primary winding for controlling the flow of current from said power source means through said primary winding, said drain terminal being connected to said primary winding.

3. The electronic ballast circuit set forth in claim 1 wherein said pulse generation means includes means for changing the width of said pulses to enable a gradual energization of said lamp from one end thereof at a variable rate towards an opposite end, thereby creating a writing effect of different speeds in said lamp.

4. The electronic ballast circuit set forth in claim 1 wherein said pulse generation means includes means for controlling the widths of said pulses so that said pulses are a train of square waves having a common duration equal to an interpulse period, whereby striations are generated in said lamp.

5. The electronic ballast circuit set forth in claim 1 wherein said switching means includes a plurality of MOSFETs connected in parallel to one another between said power supply means and ground.

6. The electronic ballast circuit set forth in claim 1 wherein said pulse generation means includes:

feedback means for generating a feedback voltage proportional to a voltage drop in said power supply means;

first reference means for generating a control voltage;

differencing means operatively connected to said first reference means and to said feedback means for generating a signal encoding a difference between said control voltage and said feedback voltage;

second reference means for generating a sawtooth reference voltage; and comparator means operatively connected to said differencing means and said second reference means for producing said train of pulse-width-modulated rectangular pulses, said comparator means having an output operatively connected to said gate terminal of said MOSFET.

7. The electronic ballast circuit set forth in claim 6 wherein said first reference means includes oscillator means for generating a rectangular waveform having a pre-established amplitude and periodicity, said first reference means further including means for producing said control voltage from said rectangular waveform.

8. The electronic ballast circuit set forth in claim 7 wherein said first reference means further includes manually adjustable means operatively connected to said differencing means and to said oscillator means for modifying said amplitude so that the width of said rectangular pulses is changed to produce a writing effect of different speeds in said lamp.

9. The electronic ballast circuit set forth in claim 6 wherein said feedback means includes said resistor and a diode connected in series across said primary winding, said capacitor and a lead extending from said capacitor and said resistor to an input of said first comparator means.

10. The electronic ballast circuit set forth in claim 1 wherein said power source means includes input terminal means for receiving an a-c input voltage and conversion means for converting said a-c input voltage to said d-c voltage.

11. The electronic ballast circuit set forth in claim 1 wherein said rectangular pulses have a pulse width sufficiently large to cause substantially instantaneous illumination of said lamp along substantially the entire length thereof upon an initial application of power to said lamp.

12. The electronic ballast circuit set forth in claim 1 wherein said rectangular pulses have a pulse width sufficiently small to cause partial illumination of said lamp upon an initial application of power to said lamp and gradual increase in the length of an illuminated portion of said lamp during subsequent continued application of power to said lamp.

13. The electronic ballast circuit set forth in claim 1 wherein said discharge means further includes a diode connected in series with said resistor and said capacitor to said primary winding.

14. An electronic ballast circuit for energizing, a gaseous discharge lamp, comprising in combination:

power source means for producing a d-c voltage;

a step-up transformer having a primary winding connected at one end to said power source means, said step-up transformer having a secondary winding connectable to the gaseous discharge lamp;

switching means connected to said primary winding for controlling the flow of current from said power source means through said primary winding, said switching means including at least one MOSFET having a drain terminal connected to said primary winding and a grounded source terminal; and control means connected to a gate terminal of said MOSFET for controlling the on and off times of said switching means, said control means including pulse generation means for generating a train of pulse-width-modulated rectangular pulses of substantially a single frequency fed to said gate terminal, said pulse generation means in turn including means for changing the width of said pulses to enable a gradual energization of said lamp from one end thereof at a variable rate towards an opposite end to create a writing effect of different speeds in said lamp.

15. The electronic ballast circuit set forth in claim 14 wherein said pulse generation means includes:

feedback means for generating a feedback voltage proportional to a voltage drop across said primary winding;

first reference means for generating a control voltage;

differencing means operatively connected to said first reference means and to said feedback means for generating a signal encoding a difference between said control voltage and said feedback voltage;

second reference means for generating a sawtooth reference voltage; and comparator means operatively connected to said differencing means and said second reference means for producing said train of pulse-width-modulated rectangular pulses, said comparator means having an output operatively connected to said gate terminal of said MOSFET.

16. The electronic ballast circuit set forth in claim 15 wherein said first reference means includes oscillator means for generating a rectangular waveform having a pre-established amplitude and periodicity, said first reference means further including means for producing said control voltage from said rectangular waveform.

17. An electronic ballast circuit for controlling the energization of a gaseous discharge lamp, comprising in combination:

power source means for producing a d-c voltage;

power supply means operatively connected to said power source means and operatively connectable to the gaseous discharge lamp for transferring thereto from said power source means electrical power of a single polarity;

switching means connected to said power supply means for controlling the flow of current from said power source means through said power supply means; and control means connected to said switching means for controlling the on and off times of said switching means, said control means including:

feedback means for generating a feedback voltage proportional to a voltage drop in said power supply means;

first reference means for generating a control voltage, said first reference means including oscillator means for generating a rectangular waveform having a pre-established amplitude and periodicity, said first reference means further including means for producing said control voltage from said rectangular waveform; and pulse-width-modulation means operatively connected to said feedback means and said reference means for producing a pulse-width-modulated train of rectangular pulses of essentially a single frequency in response to a difference between said feedback voltage and said control voltage, said pulse-width-modulation means having an output operatively connected to said switching means for controlling the on and off times of said switching means.

18. The electronic ballast circuit set forth in claim 17 wherein said pulse-width-modulation means includes:

differencing means operatively connected to said reference means and to said feedback means for generating a signal encoding a difference between said control voltage and said feedback voltage;

second reference means for generating a sawtooth reference voltage; and comparator means operatively connected to said differencing means and said second reference means for producing said pulse-width-modulated train of rectangular pulses, said second comparator means having said output operatively connected to said switching means.

19. The electronic ballast circuit set forth in claim 17 wherein said first reference means further includes manually adjustable means operatively connected to said pulse-width-modulation means and to said oscillator means for modifying said amplitude so that the width of said rectangular pulses is varied to produce a writing effect of different speeds in said lamp.

20. The electronic ballast circuit set forth in claim 17 wherein said power supply means comprises a step-up transformer having a primary winding connected at one end to said power source means, said step-up transformer having a secondary winding connectable to said lamp, said switching means being connected to said primary winding for controlling the flow of current from said power source means through said primary winding, said voltage feedback means being operatively connected to said primary winding and said pulse generation means for inducing a variation in the output thereof in accordance with variations in a voltage drop across said primary winding.

21. The electronic ballast circuit set forth in claim 17 wherein said power source means includes input terminal means for receiving an a-c input voltage and conversion means for converting said a-c input voltage to said d-c voltage.

22. An electronic ballast circuit for energizing a gaseous discharge lamp, comprising in combination:

power source means for producing a d-c voltage;

power supply means operatively connected to said power source means and operatively connectable to the gaseous discharge lamp for transferring electrical power thereto from said power source means;

switching means connected to said power supply means for controlling the flow of current from said power source means through said power supply means;

control means connected to said switching means for controlling the on and off times of said switching means, said control means including pulse generation means for generating a train of pulse-width-modulated rectangular pulses of a single frequency fed to said switching means, said control means further including voltage feedback means operatively connected to said power supply means and said pulse generation means for varying the output thereof in accordance with variations in a voltage drop in said power supply means; and writing control means operatively connected to said pulse generation means for inducing same to change the width of output pulses to enable a gradual energization of said lamp from one end thereof at a variable rate towards an opposite end to create a writing effect of different speeds in said lamp.

* * * * *